United States Patent [19]

McArthur

[11] 4,125,258

[45] Nov. 14, 1978

[54] LIMB EXERCISING APPARATUS

[76] Inventor: James A. McArthur, #5-7459-13th Avenue, Burnaby, B.C., Canada, V3N 2E2

[21] Appl. No.: 797,431

[22] Filed: May 16, 1977

[30] Foreign Application Priority Data

May 17, 1976 [CA] Canada ..... 252716

[51] Int. Cl.[2] ..... A63B 21/06

[52] U.S. Cl. ..... 272/118; 272/144; 272/DIG. 4

[58] Field of Search ..... 272/118, 117, 144, 134, 272/145, DIG. 4, 130, 142, 143

[56] References Cited

U.S. PATENT DOCUMENTS

| | | | |
|---|---|---|---|
| 3,012,776 | 12/1961 | Hotas | 272/117 |
| 3,640,527 | 2/1972 | Proctor | 272/118 |
| 3,708,166 | 1/1973 | Annas | 272/118 |
| 3,912,261 | 10/1975 | Lambert | 272/118 |

FOREIGN PATENT DOCUMENTS

| | | | |
|---|---|---|---|
| 1,405,836 | 9/1975 | United Kingdom | 272/118 |

*Primary Examiner*—Richard C. Pinkham
*Assistant Examiner*—William R. Browne
*Attorney, Agent, or Firm*—Fetherstonhaugh & Company

[57] ABSTRACT

Apparatus to be used for exercising the limbs, and particularly the legs. The apparatus includes a support upon which a person lies with his legs extending beyond an end thereof and resting on a pair of operating bars. Each bar projects from beneath the support and has at its inner end beneath the support a cam mounted to rotate around a central point, these central points being located approximately in line with the hip joints of the person on the support. A resistance in the form of a weight is connected by a flexible connector to each cam so that when the user's legs are spread apart to move the operating bars in the same direction, this movement is resisted by weight. By adjusting the connections of the flexible connectors to the cams, the weight can be made to resist the movement of the bars towards each other. The length of the strokes or movements of the operator bars away from or towards each other is adjusted by adjusting the connection of the flexible connectors to the cams.

17 Claims, 15 Drawing Figures

Figure 1:
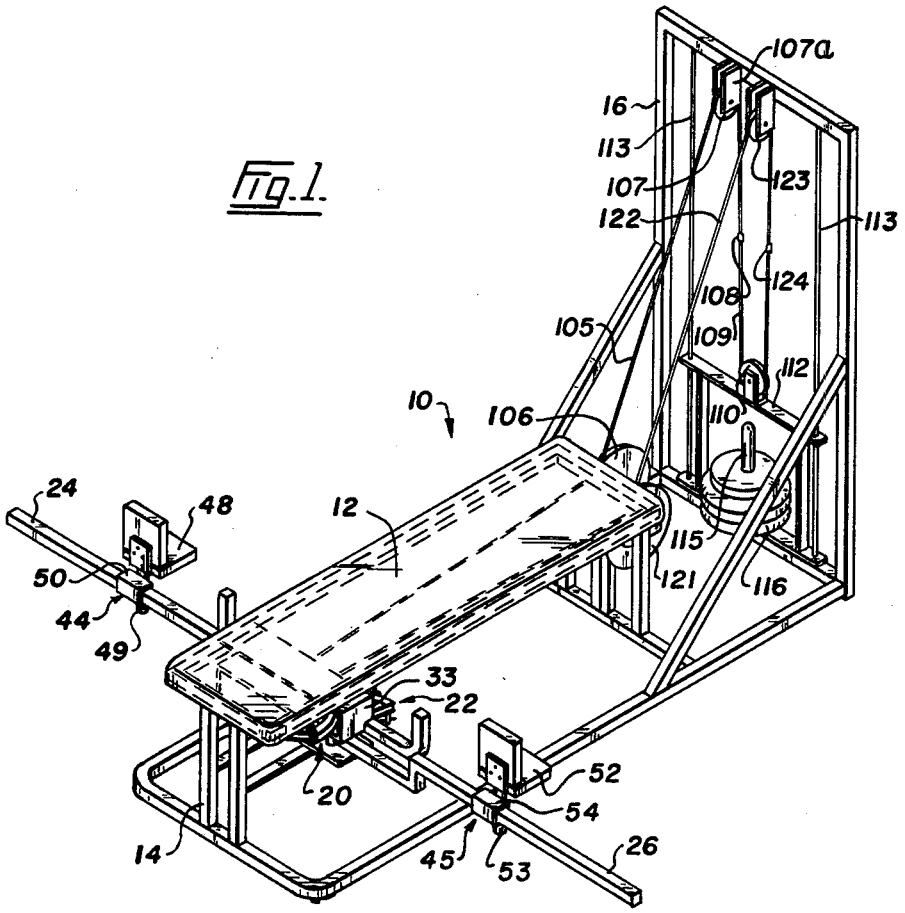

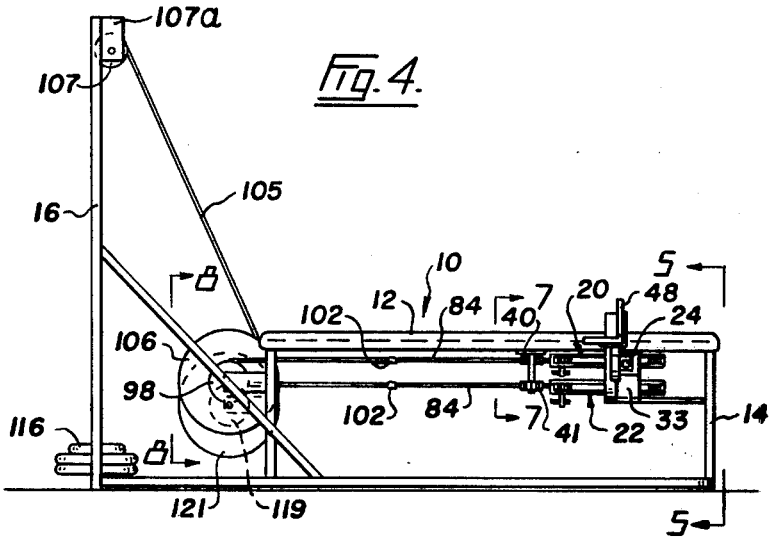
Fig. 4.
Fig. 5.
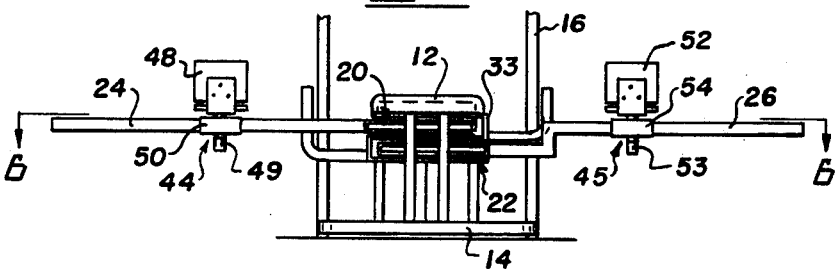
Fig. 6.
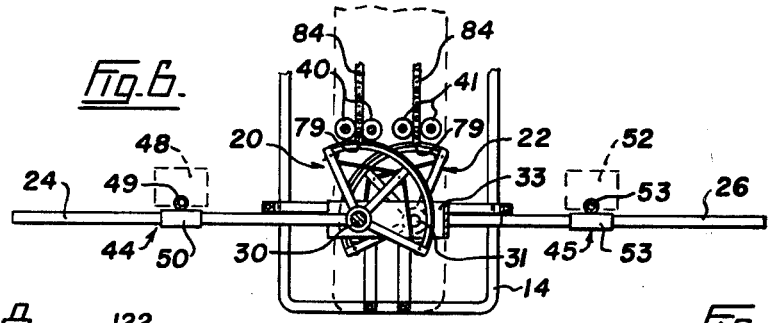
Fig. 8.
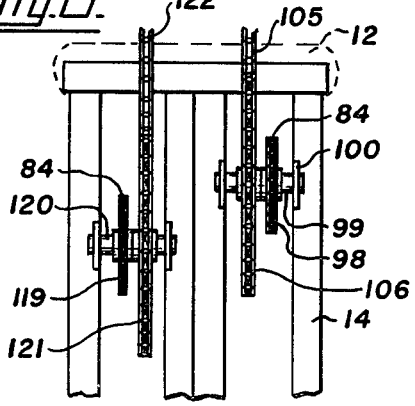
Fig. 7.
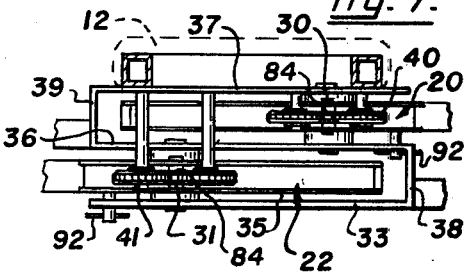

Fig. 9.
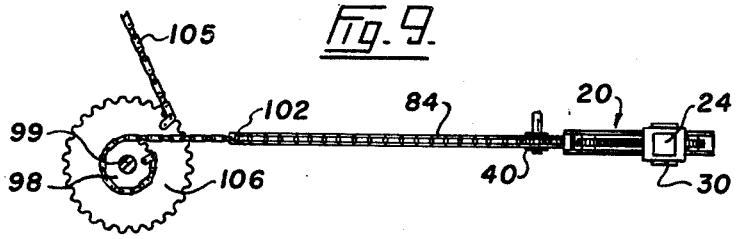
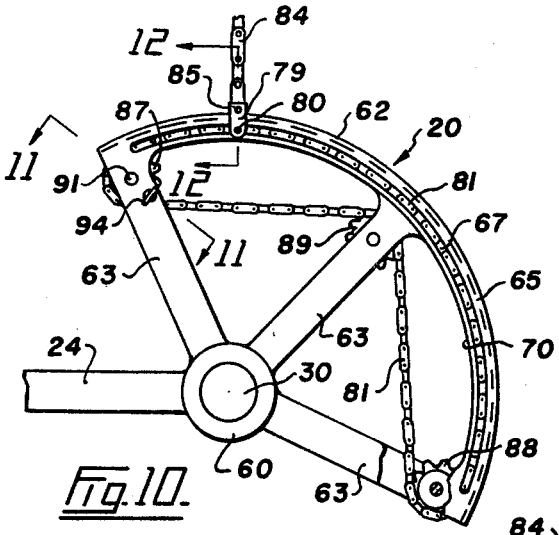
Fig. 10.
Fig. 11.
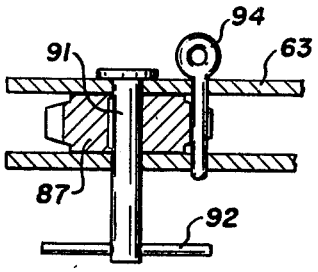
Fig. 12.
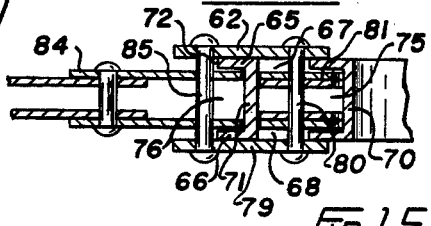
Fig. 13.
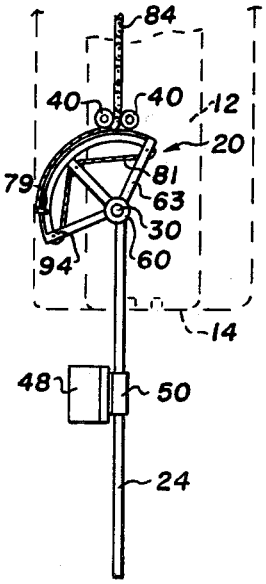
Fig. 14.
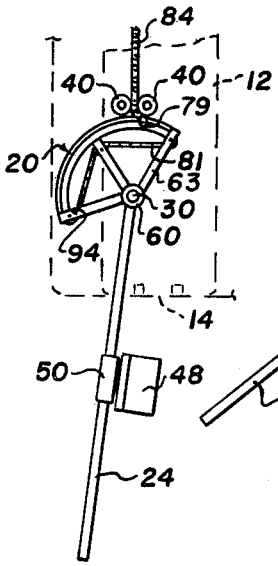
Fig. 15.
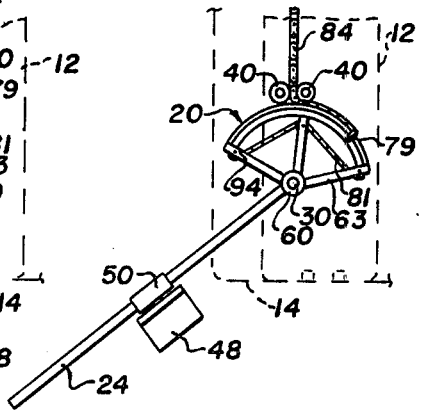

LIMB EXERCISING APPARATUS

This invention relates to apparatus for use by humans to exercise their limbs. Although primarily designed for exercising the lower limbs or legs, the apparatus can be designed to exercise the upper limbs or arms.

There are many devices and special exercises for exercising the arms and legs. However, there are no devices on the market that can be used for abduction exercises and/or adduction exercises. The legs of many people these days are subjected to accidents that require the usual types of exercises and/or abduction and adduction exercises to restore them for normal usage as soon as possible. The legs of athletes are frequently subjected to strains that require abduction and adduction exercises for reasonably quick recovery. These exercises are also to build up the legs so as to be resistant to unusual strains or blows. In spite of the frequency of these types of strain and accidents, the prior art does not have apparatus suitable for both of these exercises.

Abduction exercises are accomplished by swinging the legs away from each other in a substantially horizontal plane while subjecting this movement to resistance. Adduction exercises are accomplished by starting with the legs spread apart and then swinging them towards each other substantially in a horizontal plane while applying resistance to this movement.

The present apparatus is used for abduction and adduction exercises, and although the apparatus must be set up for either exercise, it can be quickly and easily changed for the other exercise. This apparatus is very simple in construction for the job it does, the resistance to the outward or inward movement of the legs can be adjusted to suit the condition of the user, and the length of the stroke of each leg during its inward or outward movement can readily be adjusted without interfering with the stroke of the other leg. In other words, both legs can move the same distance or one can be moved a different distance from the other one. In addition, the apparatus can be used to exercise either of the user's legs along.

This apparatus includes a cam and resistance arrangement which may be used in other types of apparatus used for exercising the limbs. One of the advantages of this arrangement is that the resistance remains constant throughout the entire exercise.

In general terms, the apparatus includes a support on which a person desiring to exercise his legs lies, and a pair of operator bars positioned to receive the person's legs either projecting longitudinally from the body or laterally from the body. A weight resistance is connected to these bars so that with one setting, when the bars are swung laterally, the weight is lifted, and in another setting, this is accomplished when the bars are swung towards each other.

Apparatus in accordance with this invention comprises a cam mounted to rotate around a central point, a surface on the cam positioned to move around said central point during rotation of the cam, an operator bar connected to the cam and extending outwardly therefrom to be moved by a limb being exercised to rotate the cam around said central point, a flexible connector, means for releasably securing one end of the connector to the cam at selected positions along said cam surface, guide means adjacent the cam surface over which the connector travels when the cam is rotated, said connector wrapping over the cam surface when the cam is rotated by the limb moving the operator bar in one direction and unwrapping from said surface when the cam is rotated in the opposite direction effectively to shorten and lengthen the connector respectively, and resistance means connected to an opposite end of the connector to resist movement thereof while said connector is being effectively shortened by rotation of the cam by pressure of the limb on the operator bar.

In more detail, the apparatus of this invention includes a support for carrying a person, and at least one exerciser unit comprising a cam mounted on the support to rotate in a substantially horizontal plane around a central point, a surface on the cam positioned to move around said central point during rotation of the cam, an operator bar connected to the cam and extending outwardly therefrom in a substantially horizontal plane to be moved by a lower limb of the person on the support to rotate the cam around said central point, a flexible connector, means for releasably securing one end of the connector to the cam at selected positions along said cam surface, guide means adjacent the cam surface over which the connector travels when the cam is rotated, said connector wrapping over the cam surface when the cam is rotated by the limb moving the operator bar in one direction and unwrapping from said surface when the cam is rotated in the opposite direction effectively to shorten and lengthen the connector respectively, and resistance means connected to an opposite end of the connector to resist movement thereof while said connector is being effectively shortened by rotation of the cam by pressure of the limb on the operator bar.

Figure 2:
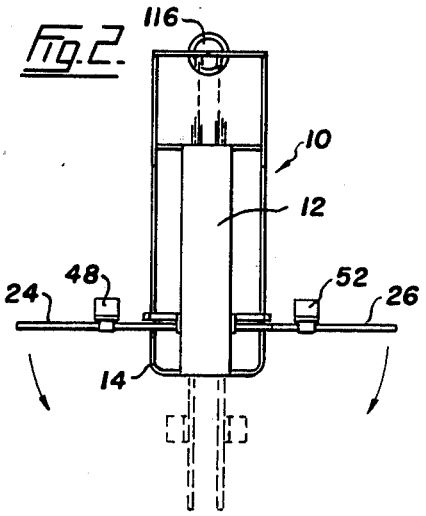
Figure 3:
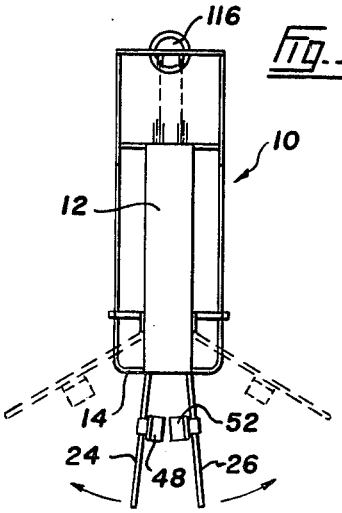

A preferred form of apparatus according to this invention is illustrated by way of example in the accompanying drawings, in which:

FIG. 1 is a perspective view of the limb exercising apparatus,

FIG. 2 is a diagrammatic plan view of the apparatus showing the operator bars thereof in the lateral extending positions ready for one form of exercise, FIG. 3 is a view similar to FIG. 2 but with the operator bars in the longitudinal extending position ready for a different exercise, FIG. 4 is a side elevation of the apparatus of FIG. 1, FIG. 5 is a fragmentary end elevation of the apparatus looking from the line 5—5 of FIG. 4, FIG. 6 is a horizontal fragmentary section taken on the line 6—6 of FIG. 5, FIG. 7 is an enlarged vertical and fragmentary section taken on the line 7—7 of FIG. 4, FIG. 8 is a vertical section taken on the line 8—8 of FIG. 4, FIG. 9 is a side elevation of a cam and flexible connector arrangement, FIG. 10 is an enlarged plan view of one of the special cams for this apparatus, FIG. 11 is an enlarged sectional view taken on the line 11—11 of FIG. 10, FIG. 12 is an enlarged section taken on the line 12—12 of FIG. 10, FIG. 13 diagrammatically illustrates the lower cam of FIG. 6 set to exercise the leg during inward swinging motion with its operator bar at the end of its inward stroke, FIG. 14 is a diagrammatic plan view of the same cam set up for an outward exercising stroke with its operator bar near the beginning of the stroke, and FIG. 15 shows the cam of FIG. 14 with its operator bar near the end of its outward stroke.

Referring to the drawings, 10 is a limb exercising device in accordance with this invention having a horizontal support 12 mounted on a base frame 14. A vertical frame 16 projects upwardly from one end of base frame 14 clear of support 12. The apparatus includes identical upper and lower cams 20 and 22 mounted close together. Cam 20 has an operator bar 24 connected thereto and projecting outwardly therefrom in the same general plane as the cam. Similarly, lower cam 22 has an operating bar 26 connected thereto and projecting outwardly therefrom substantially in the plane thereof. Cams 20 and 22 are mounted for rotation on vertical pins 30 and 31 which form central points around which the respective cams rotate, these pins being carried by an S-shaped bracket 33 mounted beneath and carried by support 12. Bracket 33 consists of vertically spaced horizontal plates 35, 36 and 37, adjacent ends of plates 35 and 36 being interconnected by a web 38, while opposite ends of plates 36 and 37 are interconnected by a web 39. Cam 20 is positioned between plates 36 and 37, while cam 22 is located between plates 35 and 36.

Referring to FIG. 6, it will be seen that pins 30 and 31 are spaced laterally from each other so that cams 20 and 22 overlap. These pins are positioned substantially below the positions where the hip joints of a person using the apparatus are located when the person is lying on support 12 in the exercising position. Suitable bearings are provided adjacent the edges of cams 20 and 22. In this example, the bearing for cam 20 comprises a pair of laterally spaced rollers 40, while the bearing for cam 22 comprises a pair of laterally spaced rollers 41. These rollers are located substantially in the planes of their respective cams. Bars 24 and 26 have leg rests 44 and 45, respectively, slidably mounted thereon for movement longitudinally of the bars. Leg rest 44 consists of an L-shaped leg support 48 swingably mounted by a pin 49 on a sleeve 50 which is slidable on bar 24. Similarly, leg rest 45 consists of an L-shaped leg support 25 swingably mounted by a pin 53 on a sleeve 54 slidable on bar 26.

As cams 20 and 22 are identical, only the upper cam 20 will now be described in detail.

FIGS. 10 to 12 illustrate cam 20 in detail. This cam includes a central hub 60 journalled on pin 30 and to which operator bar 24 is rigidly connected. The cam has a surface 62 positioned to move around central point or pin 30. In this example, surface or edge 62 is curved around hub 60 and is connected thereto by spoke 63. The cam surface or edge 62 is formed by upper and lower flanges 65 and 66, see FIGS. 10 and 12, having registering slots 67 and 68 therein extending substantially the length of the cam edge. An inner wall 70 joins the inner edges of flanges 65 and 66, see FIG. 12, and an outer wall 71 joins these flanges but is spaced inwardly from the outer edges 72 of said flanges. The wall 70 combines with flanges 65 and 66 to form an inner channel 75, while wall 71 combines with these flanges to form outer channel 76 opening outwardly from the cam edge.

A slide 79 is mounted on cam edge 62 for movement along said edge. Slide 79 is connected by a pin 80 to a cable or chain 81 riding in channel 75, this pin extending through the upper and lower slots 67 and 68 of the cam. This cable is preferably in the form of a chain, as shown. A flexible connector 84 is connector to slide 79 in any suitable manner, such as by means of a pin 85. Connector 84 is adapted to lie in outer channel 76 of the cam. Although this connector may be in the form of cable, it is preferably a chain, as shown. Cam edge 62 forms a track along which slide 79 can be moved.

As previously stated, slide 79 is connected to the portion of chain 81 lying in channel 75. This chain extends from end to end of the cam edge, and extends around sprockets 87 and 88 journaled on the end spokes 63 at opposite ends of edge 62. Chain 81 can extend directly between sprockets 87 and 88, but it is preferable to pass the chain over another sprocket 89 journalled on the center spoke 63 near cam edge 62.

Sprocket 87 is fixedly mounted on a pin 91 which extends through spoke 63 and below the latter, as shown in FIG. 11. This pin has a handle or knob 92 on its lower end by means of which the pin and sprocket 87 can be rotated. When sprocket 87 is rotated, chain 81 moves in channel 75 and shifts slide 79 along cam edge or surface 62. The slide can be locked in any desired position along each 62 in any suitable manner, and in this example, a pin 94 extends downwardly through spoke 63 and between two of the teeth of sprocket 87, as clearly shown in FIG. 11. When the pin is in this position, the sprocket cannot rotate and, consequently, chain 81 cannot move. However, when pin 94 is withdrawn, the sprocket is free to rotate.

By referring to FIG. 6, it will be seen that each of the cams 20 and 22 has flexible connector 84 connected to its slide 79 and extending outwardly from the respective cam. The connector or chain 84 of cam 20 extends between rollers 40, while the connector or chain 84 of cam 22 extends between rollers 41. The connector 84 of cam 20 extends rearwardly beneath support 12 and has an opposite end extending around and connected to a small sprocket 98 fixedly mounted on a shaft 99 carried by brackets 100 which, in turn, are mounted on a portion of base frame 14 near the inner end of support 12. Chain 84 is provided with a connector 102 so as to permit one end thereof to wrap around horizontal cam 20 and its opposite end to wrap around vertical sprocket 98.

The connector of cam 20 continues as a chain 105 connected at one end to a sprocket 106 fixedly mounted on shaft 99, sprocket 106 being larger than sprocket 98, see FIG. 9. Chain or connector 105 extends upwardly and over a sprocket 107 journalled in a bracket 107*a* mounted on vertical frame 16 near the top thereof. The opposite end of chain 105 is secured by a connector 108 to another chain 109 which extends around a sprocket 110 journalled on a weight frame 112 slidably mounted on vertical rods 113 carried by frame 16. Weight frame 112 includes a vertical pin 115 on which one or more weights 116 of different sizes can be placed. The flexible connector of cam 20 in effect consists of chain 84 sprockets 98 and 106, and chains 105 and 109. When sprocket 20 is rotated around pin 30, chain 84 wraps around and unwraps from cam surface 62 thus effectively being shortened or lengthened. The sprockets 98 and 106 are included in this connector in order to magnify the movements of the connector during rotation of the cam.

The connector 84 of cam 22 is the same as that of cam 20. The outer end of chain 84 of the latter cam extends around and is secured to a small sprocket 119, see FIG. 8, which is fixedly mounted on a shaft 120 carried by base frame 14, and a larger sprocket 121 fixedly mounted on this shaft has a chain 122 connected thereto and extending upwardly over a sprocket 123 journalled on vertical frame 16 and down to an end of chain 109 to which it is connected by connector 124. Actually, there is a flexible connector extending between the slides of the two cams and consisting of chains 84, 105, 122 and 109, this endless connector extending over sprockets 107 and 123 and under sprocket 110. The sprockets 98, 106 and 119, 121 form part of this connector and magnify the effective lengthening and shortening thereof. When either or both of the cams 20 and 22 are rotated in the appropriate direction, this movement is resisted by weights 116 which are raised by frame 112. The weights are raised by movements of either or both of the cams, and the degree of movement of either one does not affect the movement of the other because of the fact that the cams are connected to the weight frame by chain 109 which travels around sprocket 110 mounted on the frame.

With the slide 79 of cam 20 in the position shown in FIGS. 6 and 10, bar 24 is retained normally in the position projecting laterally relative to the apparatus. The slide is adjacent one end of cam surface 62 at this time and weight frame 112 is resting on the bottom of vertical frame 16. Swinging movement of bar 24 towards the longitudinal position projecting from the end of support 12 causes connector 84 to wrap around cam surface or edge 62, which movement is resisted by weight 116 since weight frame 112 is lifted by this action. When the bar is released, the weight frame drops to the bottom, drawing bar 24 back to its lateral position.

When slide 79 of cam 20 is moved to a position near the opposite end of cam surface 62, bar 24 is retained in the longitudinal position by the weights which are at rest at this time. When the bar is moved towards the lateral position, the movement is resisted by the weights, and when the pressure on the bar is released, the weights restore it to its normal position at this time.

A person desiring to exercise his legs lies on support 12 and with the apparatus set as shown in FIG. 1, swings his legs outwardly and rests them on supports 48 and 52. He can now draw his legs together which swing bars 24 and 26 towards the longitudinal position, this movement being resisted by weights 116 which are lifted at this time. When the user relaxes his legs, the weights swing the bars and his legs back to the lateral starting position. The user can move one leg at a time or both of them together. He can adjust the amount of movement for each leg by pulling out the pin 94 of the cam involved and by rotating sprocket 87 by handle 92 to shift slide 79 in the desired direction along cam surface 62. When pin 94 is returned to its position between the teeth of sprocket 87, slide 79 is locked in position.

When it is desired to change the exercise so that the movement of the legs from the longitudinal position towards the lateral position is resisted, the pins 94 of the two cams are withdrawn and their slides 79 are shifted to the opposite ends of the cam surfaces, as shown in FIGS. 14 and 15, and then the slides are locked in position. When the weights are now at rest, the bars 24 are retained in the longitudinal position. Supports 48 and 52 are swung around to face in the opposite direction so as to be ready to receive the user's legs. As the user spreads his legs to swing the bars towards their lateral positions, weights 116 are raised, and when he relaxes his legs, the weights swing them back to their original position.

The apparatus 10 can be quickly and easily adjusted for the two different leg exercises, (a) the abduction exercise when the outward movement of the legs is resisted and (b) the adduction exercise when the movement of the legs inwardly or towards each other is resisted. The user can easily adjust the length of the leg stroke for either of his exercises.

It is obvious that in place of weights 116, one or more springs or pneumatic cylinders can be employed to resist the leg movements. However, weights are preferred since their resistance remains the same throughout the entire stroke of the leg, whereas with springs and cylinders the resistance changes.

The core of this apparatus is the cams 20 and 22 with their associated elements. These cams act to convert straight line resistance to rotary motion thereby duplicating the body motion, and they are means for applying constant and direct resistance to the movement of the limb throughout the full range of the motion possible thereto. Each cam converts a swinging motion into a longitudinal motion, and the amount of each stroke and the direction of the resistance to the movement can be easily adjusted by shifting the cam slide 79. This makes it easy to change the operation from an exercise of the limbs during movement in one direction to an exercise during movement of the limbs in the opposite direction. Although this apparatus is primarily designed for exercising the legs, it is obvious that the cam and resistance arrangement can be used for similar exercises of the arms. The adjustability of the cams makes it possible to provide the two opposite types of exercise in a single machine. This eliminates the necessity for a second machine with the expense involved and the loss of the floor space a second machine would entail.

I claim:

1. Apparatus for use by human beings to exercise their limbs, comprising a cam mounted to rotate back and forth around a central point between first and second positions, a surface on the cam positioned to move around said central point during rotation of the cam and having first and second opposite ends, an operator bar connected to the cam and extending outwardly therefrom to be moved by a limb being exercised to rotate the cam between said first and second positions around said central point, guide means adjacent the cam surface between said first and second ends, said surface moving back and forth past the guide means during said movement of the cam, a flexible connector, securing means for releasably connecting an end of the connector to the cam at selected positions along said surface on opposite sides of the guide means, said connector travelling over the guide means when the cam is rotated back and forth, said connector respectively wrapping over and unwrapping from the cam surface when the cam is rotated back and forth by the limb moving the operator bar effectively to shorten and lengthen the connector respectively, and resistance means connected to an opposite end of the connector to resist movement thereof while said connector is being effectively shortened, said connector being effectively shortened when the securing means connects the connector to the cam between the guide means and the first cam surface end or alternatively between said guide means and the second cam surface end when the operator bar is moved by pressure of the limb to move the cam towards the first position thereof or alternatively towards the second position thereof.

2. Exercising apparatus as claimed in claim 1 including a limb rest mounted on and adjustable longitudinally of the operator bar.

3. Exercising apparatus as claimed in claim 1 in which said resistance means comprises a weight connected to said opposite end of the connector.

4. Exercising apparatus as claimed in claim 1 in which said resistance means comprises an adjustable weight connected to said opposite end of the connector.

5. Exercising apparatus as claimed in claim 1 in which said cam surface comprises a track, and said securing means comprises a slide mounted for movement along said track between said ends of the cam surface and to which the connector is secured, and means for releasably securing the slide to the track at different positions along said track.

6. Exercising apparatus as claimed in claim 1 in which said cam surface comprises a track, and said securing means comprises a slide mounted for movement along said track and to which the connector is secured, guide means along the track, an endless cable carried by the cam, a portion of said cable extending through the guide means along the track, means securing the slide to the portion of the cable extending along the track whereby longitudinal movement of the cable moves the slide along the track, and means connected to the cable for releasably securing said cable against longitudinal movement.

7. In apparatus for use by human beings to exercise their limbs and including a support for carrying a person, a lower limb exercisor unit comprising a cam mounted on the support to rotate in a substantially horizontal plane back and forth around a central point between first and second positions, a surface on the cam positioned to move around said central point during rotation of the cam and having first and second opposite ends, an operator bar connected to the cam and extending outwardly therefrom in a substantially horizontal plane to be moved by a lower limb of the person on the support to rotate the cam between said first and second positions around said central point, guide means adjacent the cam surface between said first and second ends, said surface moving back and forth past the guide means during said movement of the cam, a flexible connector, securing means for releasably connecting one end of the connector to the cam at selected positions along said surface on opposite sides of the guide means, said connector travelling over the guide means when the cam is rotated back and forth, said connector respectively wrapping over and unwrapping from the cam surface when the cam is rotated back and forth by the limb moving the operator bar effectively to shorten and lengthen the connector respectively, and resistance means connected to an opposite end of the connector to resist movement thereof while said connector is being effectively shortened, said connector being effectively shortened when the securing means connects the connector to the cam between the guide means and the first cam surface end or alternatively between said guide means and the second cam surface end when the operator bar is moved by pressure of the limb to move the cam towards the first position thereof or alternatively towards the second position thereof.

8. Exercising apparatus as claimed in claim 7 including a second exerciser unit the same as the first mentioned exercise unit, the central points of the cams of the first and second units and the operator bars of said units being so located that said bars can be moved towards and away from each other by the limbs of the person on the support to rotate the respective cams.

9. Exercising apparatus as claimed in claim 8 in which the central points of the cams are located below said support approximately in line with the hip joints of a person positioned on said support to exercise his limbs, and said operator bars are movable between positions substantially parallel to each other and positions extending outwardly from each other.

10. Exercising apparatus as claimed in claim 9 including a vertical frame adjacent an end of said support, and the connector of one of the cams extends therefrom around rotatable bearings on the support and the frame and back to the other of said cams, said resistance means comprises a weight within said frame and connected by a rotatable bearing to said connector to be raised and lowered thereby.

11. Exercising apparatus as claimed in claim 9 including a vertical frame adjacent an end of said support, and vertical guide means in the frame, and the connector of one of the cams extends therefrom around rotatable bearings on the support and the frame and back to the other of said cams, and said resistance means comprises a weight mounted in said guide means for vertical movement and connected by rotatable bearing to said connector to be raised and lowered thereby.

12. Exercising apparatus as claimed in claim 8 in which said resistance means of each unit comprises a weight connected to said opposite end of the connector thereof.

13. Exercising apparatus as claimed in claim 8 including a vertical frame adjacent an end of said support, and the connector of one of the cams extends therefrom around rotatable bearings on the support and the frame and back to the other of said cams, and said resistance means comprises a weight within said frame and connected by a rotatable bearing to said connector to be raised and lowered thereby.

14. Exercising apparatus as claimed in claim 8 including a vertical frame adjacent an end of said support, and vertical guide means in the frame, and the connector of one of the cams extends therefrom around rotatable bearings on the support and the frame and back to the other of said cams, and said resistance means comprises a weight mounted in said guide means for vertical movement and connected by a rotatable bearing to said connector to be raised and lowered thereby.

15. Exercising apparatus as claimed in claim 7 in which said resistance means comprises a weight connected to said opposite end of the connector.

16. Exercising apparatus as claimed in claim 7 in which each cam surface comprises a track, and each securing means comprises a slide mounted for movement along said track and to which the connector is secured, and means for releasably securing the slide to the track at different positions along said track.

17. Exercising apparatus as claimed in claim 7 in which each cam surface comprises a track, and each securing means comprises a slide mounted for movement along said track and to which the connector thereof is secured, guide means along the track, an endless cable carried by the cam, a portion of said cable extending through the guide means along the track, means securing the slide to the portion of the cable extending along the track whereby longitudinal movement of the cable moves the slide along the track, and means connected to the cable for releasably securing said cable against longitudinal movement.

* * * * *